US011103901B2

(12) United States Patent
Lendi

(10) Patent No.: US 11,103,901 B2
(45) Date of Patent: Aug. 31, 2021

(54) ULTRA-HIGH PRESSURE NOZZLE FOR CLEANING PIPES, WITH SEAL

(71) Applicant: Enz Technik AG, Giswil (CH)

(72) Inventor: Christoph Lendi, Giswil (CH)

(73) Assignee: ENZ TECHNIK AG, Giswil (CH)

( * ) Notice: Subject to any disclaimer, the term of this patent is extended or adjusted under 35 U.S.C. 154(b) by 27 days.

(21) Appl. No.: 16/381,498

(22) Filed: Apr. 11, 2019

(65) Prior Publication Data

US 2019/0314875 A1 Oct. 17, 2019

(30) Foreign Application Priority Data

Apr. 13, 2018 (CH) ..... 00470/18

(51) Int. Cl.
*B08B 9/045* (2006.01)
*B05B 3/06* (2006.01)
*B05B 1/14* (2006.01)

(52) U.S. Cl.
CPC ..... *B08B 9/045* (2013.01); *B05B 3/06* (2013.01); *B05B 1/14* (2013.01)

(58) Field of Classification Search
CPC .. B08B 9/045; B05B 3/06; B05B 1/14; B05B 13/0636; B05B 15/65
USPC ..... 239/251, 264
See application file for complete search history.

(56) References Cited

U.S. PATENT DOCUMENTS 5,402,936 A 4/1995 Hammelmann
6,698,669 B2 * 3/2004 Rieben ..... F16C 19/54 239/225.1

FOREIGN PATENT DOCUMENTS

CH 707524 A2 7/2014
EP 600403 A1 6/1994

* cited by examiner

*Primary Examiner* — Christopher S Kim
(74) *Attorney, Agent, or Firm* — Paul D. Bianco; Katharine Davis; Fleit Intellectual Property Law

(57) ABSTRACT

An ultra-high pressure nozzle comprises a stator with a stator channel and a rotor with a rotor channel. A transition from the stator channel to the rotor channel is achieved by a seal, which comprises a rotor bearing hollow body with a rotor bearing channel crossing it in a longitudinal direction and a stator bearing hollow body with a stator bearing channel crossing it in a longitudinal direction. The rotor bearing hollow body is in a fixed location and protrudes into the rotor channel and the stator bearing hollow body is in a fixed location and protrudes into the stator channel. The rotor bearing hollow body and the stator bearing hollow body do not overlap each other. When the nozzle is mounted, the front surface of the rotor bearing hollow body rests in direct contact with a front surface of the stator bearing hollow body in a rotatable manner, thereby creating a seal.

20 Claims, 2 Drawing Sheets

ULTRA-HIGH PRESSURE NOZZLE FOR CLEANING PIPES, WITH SEAL

TECHNICAL FIELD

The present invention relates to an ultra-high pressure nozzle driven by a pressure-transmitting medium for cleaning pipes, comprising a stator part with a stator part channel and a rotor part with a rotor part channel, said rotor part supported rotatably about a longitudinal axis of the ultra-high pressure nozzle for cleaning pipes relative to the stator part via at least one set of roller bearings, wherein a transition from the stator part channel to the rotor part channel is achieved via a seal and wherein the rotor part can be attached rotatably relative to the stator part by a compression joint.

STATE OF THE ART

Ultra-high pressure nozzles driven by a pressure-transmitting medium for cleaning pipes are known for various purposes. In this context, the term "ultra-high pressure" is understood to describe supply pressures of the pressure-transmitting medium of 1,000 bar to 3,000 bar. The pressure-transmitting medium has the effect of rotating a rotor part rotationally about a longitudinal axis of the ultra-high pressure cleaning nozzle relative to a non-rotatable stator part. The rotor part essentially functions in the same manner as a hollow shaft, as the pressure-transmitting medium is moved from a high-pressure line connection, usually designed in the form of a screw coupling, through a stator part channel into a rotor part channel. The discharge of the pressure-transmitting medium from respective nozzles at the rotor part and/or at a rotor head arranged on the rotor part has the effect of rotating the rotor part relative to the stator part. In the course of this process, at least one cleaning pressure-transmitting medium stream is discharged.

Many ultra-high pressure nozzles for cleaning pipes use a roller-bearing-free support of the rotor part on a stator, wherein a liquid film is generated, on which the rotor part is supported rotatably. In such ultra-high pressure nozzles for cleaning pipes, the sealing connection between the stator part and the rotor part is problematic. As known from EP600403, the seal between rotor part and stator part can be solved by a labyrinth seal. This comprises a plurality of insert sleeves, which must have annular grooves for forming the labyrinth seal. In order to achieve the desired, durable overlap of the insert sleeves during operation under pressures of up to 3,000 bar, the insert sleeves must be manufactured with great precision. Even minor deviations from the target measurements will lead to increased leakage and possibly to a failure of the labyrinth seal. Even if they are manufactured with great precision, the insert sleeves wear quickly and have to be replaced within disadvantageously short periods of time.

The goal therefore was to eliminate the mounting on a liquid film and the hydraulic bearings, as these appear to be too cumbersome to design and because their achievable service life was too short.

An ultra-high pressure nozzle for cleaning pipes is known from CH 707 524, which is registered to the present applicant and which includes a rotor part supported rotatably on a stator part via two ball bearings. The stator part is crossed by a stator part channel from the side of a screw coupling in the direction toward a central rotor part channel in the rotor part. A bearing pin is arranged such that it protrudes into the rotor part channel 10, said bearing pin having an outer ring, which is connected to a ring on the front surface of the stator part outside of the stator part channel. When the rotor part rotates, the two rings rub against each other outside of the rotor part channel and the stator part channel without making direct contact with the pressure-transmitting medium. The rotor part is pressed against the front surface of the stator part by a screw connection. However, in practical applications, such ultra-high pressure nozzles for cleaning pipes at times experience undesirably high rates of leakage and too much wear on the seals. This means that the rings and the bearing pin have to be replaced often. Such a seal between rotor part and stator part cannot withstand the high pressures of the pressure-transmitting medium of 2,800 bar and more long enough, which means its service life is too short.

SUMMARY OF THE INVENTION

One aspect of the disclosure relates to a ultra-high pressure nozzle driven by a pressure-transmitting medium for cleaning pipes with a sealing effect in the path of the channel guiding the medium from the stator part to the rotor part that is sufficient at maximum pressures of more than 2,000 bar, thus providing a robust, durable seal. The intervals at which the parts subject to wear have to be replaced are intended to be increased significantly compared to the known ultra-high pressure nozzle for cleaning pipes.

Another aspect of the invention relates to a ultra-high pressure nozzle for cleaning pipes, which can be manufactured more simply and at lower cost, and which guarantees a longer service life even at operating pressures between 1,000 and 3,000 bar or even beyond.

As disclosed herein, a ultra-high pressure nozzle for cleaning pipes includes a special seal, whereby several advantages are achieved by changes in design. Preferred embodiments are also disclosed herein.

BRIEF DESCRIPTION OF THE DRAWINGS

A preferred exemplary embodiment of the subject matter of the invention is described in the following in the context of the attached drawings. The drawings show.

DETAILED DESCRIPTION

Figure 1:
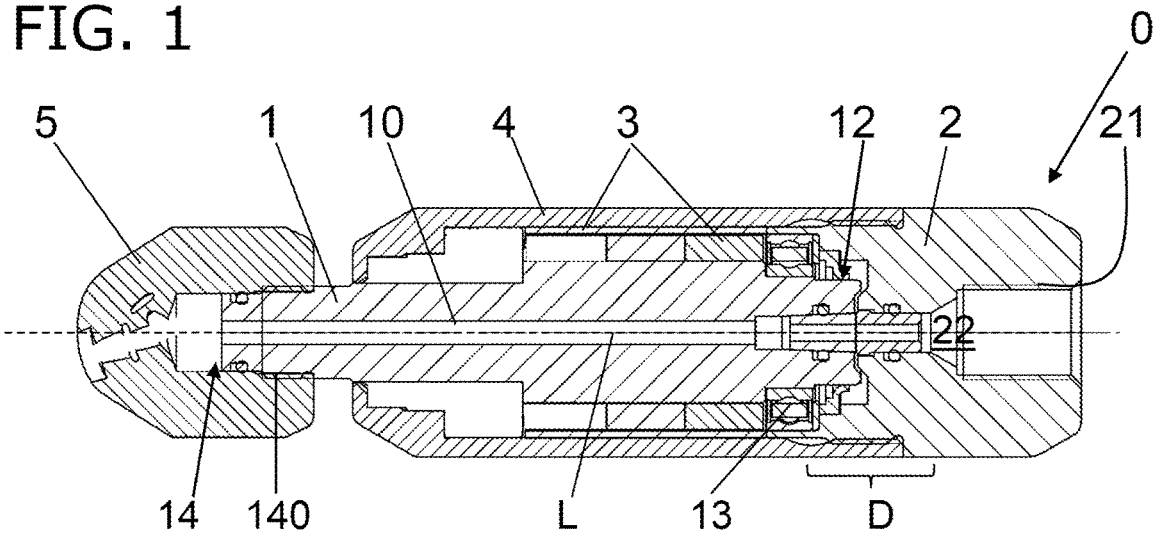
FIG. 1 A partially schematic sectional view of a longitudinal cross-section of a ultra-high pressure nozzle for cleaning pipes.

The following describes an ultra-high pressure nozzle for cleaning pipes 0 of the aforementioned type through the use of drawings, said nozzle essentially comprising a rotor part 1 and a stator part 2. The rotor part 1 includes a head end 14 with a thread 140, to which a rotor head 5 is attached by being screwed onto the same. The rotor part 1 is press-fitted onto the stator part 2 and is supported rotatably relative to the stator part 2. A housing 4 is provided, which at least partially surrounds the rotor part 1 and the stator part 2, and which provides an non-detachable connection of the rotor part 1 in the direction of the longitudinal axis L. The housing 4 rotatably holds the rotor part 1 in the proximity of the head end 14 and is attached to an exterior thread on the stator part 2 via a respective interior thread. To enable the rotation of the rotor part 1, at least one roller bearing 13 is arranged between the rotor part 1 and the stator part 2 with a direct or indirect connection. Preferably, a plurality of sets of roller bearings are arranged on the rotor part 1 along the longitudinal axis L. The cleaning effect, the forward drive and the rotation are caused by a pressure-transmitting medium, which is discharged through various nozzles. As the design of these nozzles is not particularly relevant here, it will not be explained in any more detail.

The rotor part 1 is crossed by a rotor part channel 10 in its entirety. Preferably, the rotor part channel 10 concentrically penetrates the rotor part 1, from a rotor bearing pin 12 to the head end 14. The stator part 2 is completely penetrated by a screw coupling 21 and an adjacent stator part channel 22. In this context, the passageway of the screw coupling 21 opens onto the concentric stator part channel 22. A high-pressure line connection is attached to the screw coupling 21 on the side of the stator part 2 that faces the rotor part 1, whereby water can be applied to the stator part channel 22 and the rotor part channel 10.

A seal D is arranged at the transition between stator part channel 22 and rotor part channel 10, said seal being designed in multiple parts and ensuring an uninhibited rotation of the rotor part 1, wherein only small amounts of the pressure-transmitting medium, preferably water, are allowed to leak out. To enable a retarded rotational movement of the rotor part 1 about its longitudinal axis L, breaking aids 3 are placed along the outer circumference of the rotor part 1, which preferably are designed as permanent magnets and which together with the housing 4 of the rotor part 1 form an eddy current brake.

Figure 2A:
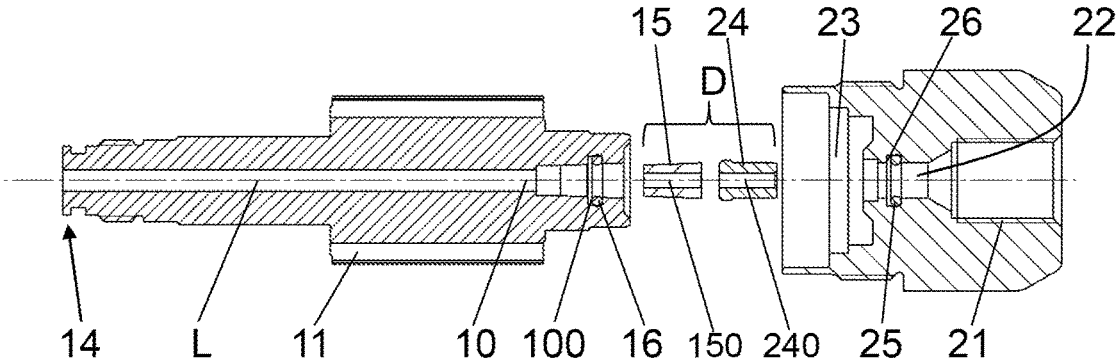
FIG. 2*a* A longitudinal cross-section of an exploded view of a rotor part, a seal and a stator part.
Figure 2B:
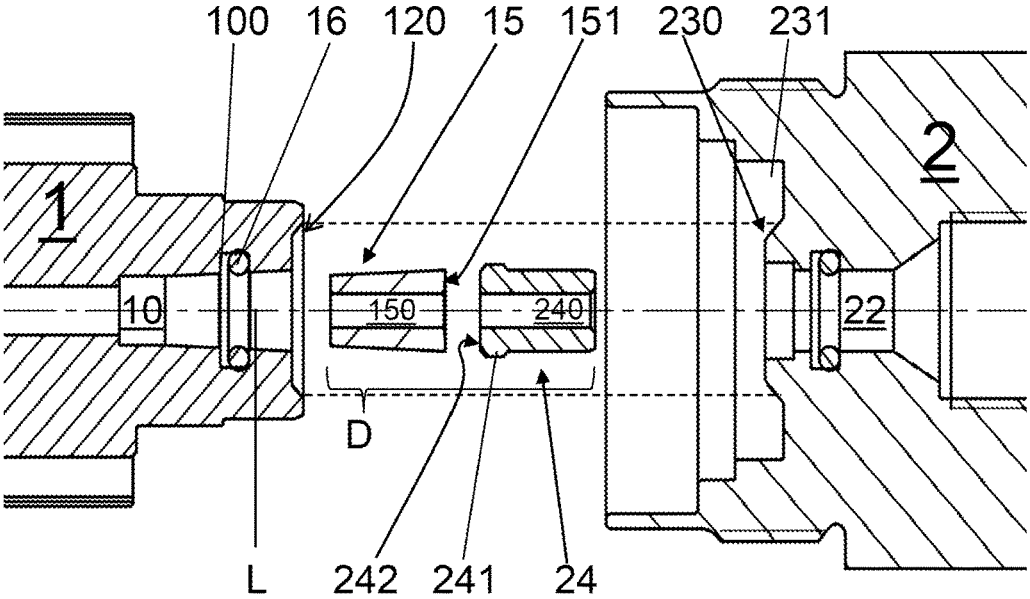
FIG. 2*b* The section containing the seal according to FIG. 2*a* in a detailed, longitudinal view.

The exploded view according to FIG. 2*a* shows rotor part 1, seal D and stator part 2 together for simplicity's sake. Tappets 11 are arranged along the rotor part 1, which catch the braking aids 3, which are not shown in FIG. 2*a*. During the rotation of the rotor part 1 about the longitudinal axis L, the braking aids 3 are rotated along accordingly, while the housing 4 remains in position without rotating. The rotor bearing pin 12 is inserted into a recess 23 on the stator part 2 and is rotatably supported there.

The seal D comprises a rotor bearing hollow body 15 with a central rotor bearing channel 150. The rotor bearing hollow body 15 is set into the rotor part channel 10 in the area of the rotor bearing pin 12 and is supported in a fixed position in the same. An undercut 100 is recessed in the rotor part channel 10, wherein a sealing ring 16, in the form of an O-ring 16 in this case, can be inserted into said undercut and supported in the same. The outer contour of the rotor bearing hollow body 15 can be designed in a cone shape; correspondingly, the rotor part channel 10 should then also be designed in a cone shape. Even at high rotational speeds, the rotor bearing hollow body 15 can thus be prevented from rotating. The use of an O-ring 16 improves the seal against the rotor part channel 10.

Another part of the seal D is the stator bearing hollow body 24 with a central stator bearing channel 240. The stator bearing hollow body 24 is at least partially set into the stator part channel 22 and is supported in a fixed position in the same. Here, the stator bearing hollow body 24 is designed with an essentially cylindrical cross-section, which is inserted in the longitudinal direction L into the stator part channel 22, protruding in the direction of the screw coupling 21. A sealing ring 25, in the form of an O-ring 25 in this case, is arranged in an undercut 26, supported in the stator part channel 22. As the rotor part channel 10 and the stator part channel 22 are subjected to a pressure-transmitting medium under high pressures of more than 1,000 bar while in operation, it is preferable to use the O-rings 16 and 25 to improve the seal.

In the mounted state of the ultra-high pressure nozzle for cleaning pipes 0, the rotor bearing hollow body 15 and the stator bearing hollow body 24 are in direct contact with each other and form the seal D, which permits a rotational movement of the rotor part 1 relative to the stator part 2 with only minor leakage of the pressure-transmitting medium. The rotor bearing hollow body 15 has a front surface 151 and the stator bearing hollow body 24 has a front surface 242. The rotor bearing hollow body 15 and the stator bearing hollow body 24 are formed from carbide. Preferably used carbides comprise more than 70% of tungsten carbide in the form of particles, which are bonded in a matrix of up to 27% cobalt and/or nickel.

Both central channels 150 and 240 preferably have the same profile.

By designing the stator bearing hollow body 24 as a cylinder, a length compensation can be achieved in the direction of the longitudinal axis L when the stator bearing hollow body 24 is supported in the stator part channel 22.

To guarantee that the stator bearing hollow body 24 does not turn, a collar 241 is provided on the stator bearing hollow body 24, which is designed on the edge of the stator bearing hollow body 24 on the side facing the rotor part channel 10.

The rotor part 1 is designed with a rotor bearing pin 12, which is inserted into the recess 23 on the stator part 2 and which comes to rest against centring aids 230 on the stator part 2 with a centring aid 120 of the rotor part 1. The centring aids 120 on the rotor part 1 are designed as a centring indentation 120 here, while the centring aids 230 are shaped as centring protrusion 230 on the stator part 2. The centring indentation 120 is continued here with dashed lines in the direction of stator part 2. When the centring aids 120 and 230 are pressed against each other they are connected so as to operate jointly. When the pressure-transmitting medium passes the seal D, the pressure-transmitting medium is discharged into a discharge chamber 231, from which the pressure-transmitting medium can escape out of the housing 4 via designated bore holes.

Figure 3:
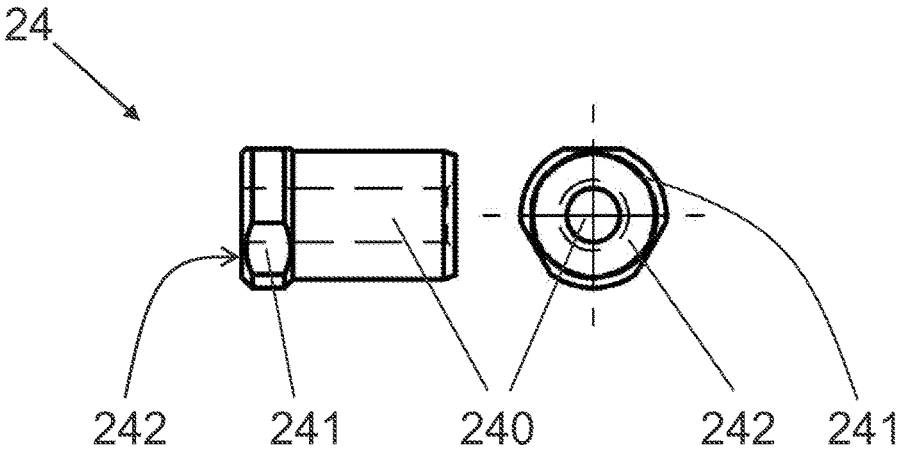
FIG. 3 A side view of the stator bearing hollow body and a view in the direction of the longitudinal axis of the same.

As can be seen in FIG. 3, the collar 241 correspondingly is designed such that the stator bearing hollow body 24 cannot rotate along with the rotor part 1 after the insertion of the stator part channel 22. The diameter of the collar 241 is larger in some parts than the diameter of the stator part channel 22. The profile of the collar 241 is not designed in a circular shape, but has flattened edges. As the profile of the collar 241 in at least some parts is larger than the profile of the stator part channel 22, it is guaranteed that the two cannot rotate relative to each other.

To facilitate the insertion of the rotor bearing hollow body 15 and/or of the stator bearing hollow body 24 into the respective channel 10 and/or 22, the exterior areas of the bodies 15 and 24 are designed in round shapes.

Figure 4:
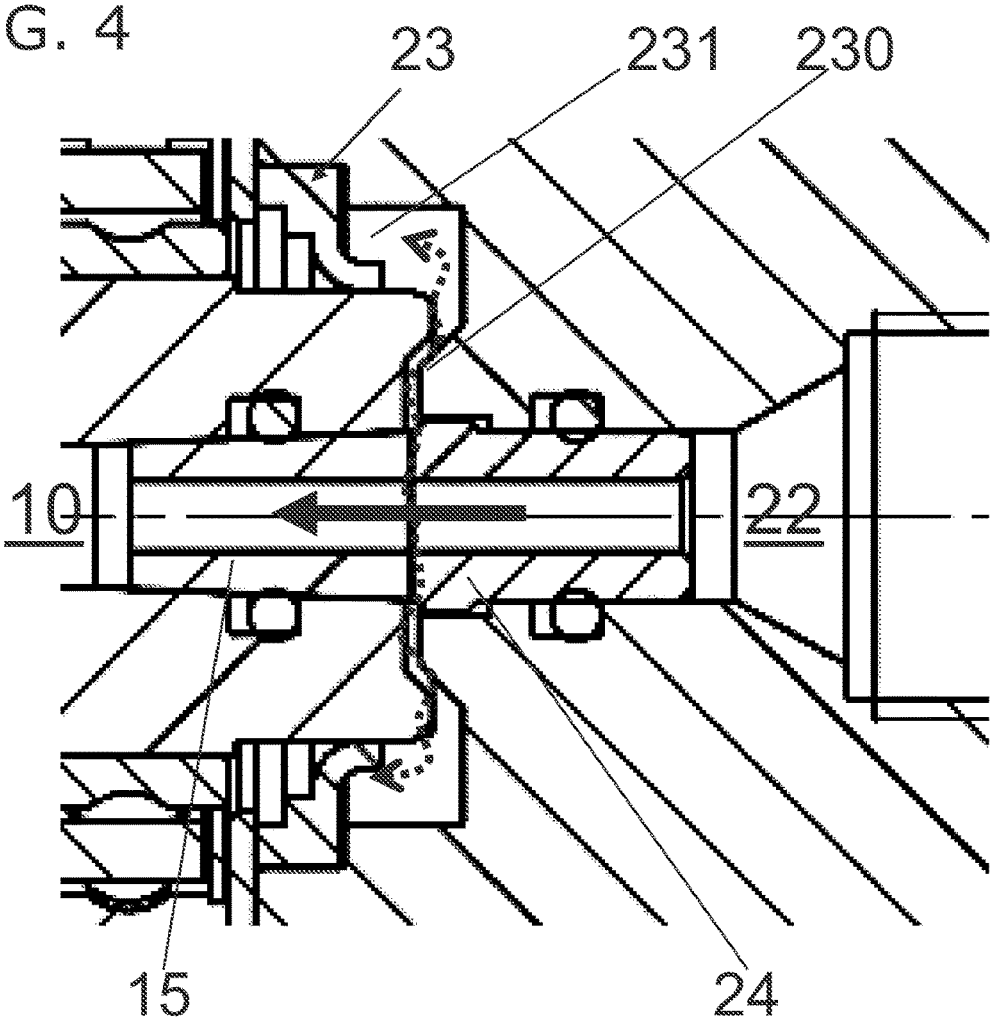
FIG. 4 The area of the seal of the ultra-high pressure nozzle for cleaning pipes in its mounted state in a detailed longitudinal view.

When the ultra-high pressure nozzle for cleaning pipes 0 is mounted and when pressure is applied to the same, the main stream of the pressure-transmitting medium flows from the stator part channel 22 through the stator bearing hollow body 24 or, respectively, the stator bearing channel 240, and the rotor bearing hollow body 15 or, respectively, the rotor bearing channel 150, into the rotor part channel 10. A small amount of the pressure-transmitting medium escapes between the front surfaces 151 and 242 of the rotor bearing hollow body 15 and the stator bearing hollow body 24 into the discharge chamber 231. The discharge chamber 231 is formed between the stator part 2 and the rotor part 1, and is surrounded by the housing 4. Because discharge bore holes are provided in the housing 4, the pressure-transmitting medium finally can escape from the housing 4. The escaping pressure-transmitting medium is indicated with the dashed arrows in FIG. 4, wherein the discharge openings in the housing 4 are not indicated.

LIST OF REFERENCE NUMBERS

0 Ultra-high pressure nozzle for cleaning pipes
1 Rotor part
10 Rotor part channel
100 Undercut
11 Tappet
12 Rotor bearing pin
120 Centring aids
13 Roller bearing/ball bearing
14 Head end
140 Thread
15 Rotor bearing hollow body
150 Central rotor bearing channel in the rotor bearing cone
151 Front surface
16 O-ring/seal ring
2 Stator part
21 Screw coupling
22 Stator part channel
23 Recess
230 Centring aids
231 Discharge chamber
24 Stator bearing hollow body
240 Stator bearing channel in the stator bearing cone
241 Collar
242 Front surface
25 O-ring/seal ring
26 Undercut
3 Breaking aid
4 Housing
5 Rotor head
L Longitudinal axis
D Seal

The invention claimed is:

1. A nozzle, driven by a pressure-transmitting medium, for cleaning pipes, the nozzle comprising:

a stator part including a stator part channel;

a rotor part having a rotor bearing pin configured for insertion into a recess on the stator part, the rotor part held by a housing, and including a rotor part channel, the rotor part attachable rotatably relative to the stator part and supported rotatably, about a longitudinal axis of the nozzle relative to the stator part, by at least one roller bearing; and a seal forming a transition from the stator part channel to the rotor part channel, the seal including:

a rotor bearing hollow body having a conical outer contour and including a rotor bearing channel crossing the rotor bearing hollow body in a longitudinal direction, the rotor bearing hollow body arrangeable such that the rotor bearing hollow body is fixed and at least partially protrudes into the rotor part channel of the rotor part; and a stator bearing hollow body having a cylindrical shape opening into a collar and including a stator bearing channel crossing the stator bearing hollow body in a longitudinal direction, the stator bearing hollow body arrangeable such that the stator bearing hollow body is fixed and at least partially protrudes into the stator part channel of the stator part;

wherein, when the nozzle is mounted, a front surface of the rotor bearing hollow body directly contacts an opposing front surface of the stator bearing hollow body forming a flat plane at the seal perpendicular to a direction of flow of the pressure-transmitting medium such that the rotor bearing hollow body and the stator bearing hollow body do not extend over one another in a direction of the longitudinal axis.

2. The nozzle according to claim 1, wherein the nozzle is capable of operating at supply pressures of the pressure-transmitting medium between 1000 and 3000 bars.

3. The nozzle according to claim 1, wherein the rotor bearing hollow body and the stator bearing hollow body are formed from carbide.

4. The nozzle according to claim 1, wherein a profile of the rotor part channel has a conical shape.

5. The nozzle according to claim 1, wherein profiles of the rotor bearing channel and the stator bearing channel are identical.

6. The nozzle according to claim 1, wherein a profile of the collar of the stator bearing hollow body has flattened edges configured to prevent rotation of the stator bearing hollow body.

7. The nozzle according to claim 1, further comprising an undercut recessed in the rotary part channel for attaching the rotor bearing hollow body and an undercut recessed in the stator part channel for attaching the stator bearing hollow body.

8. The nozzle according to claim 7, wherein the rotor bearing hollow body is attached in the undercut recessed in the rotor part channel with a sealing ring and wherein the stator bearing hollow body is attached in the undercut recessed in the stator part channel with a sealing ring.

9. A nozzle, driven by a pressure-transmitting medium, for cleaning pipes, the nozzle comprising:

a stator part including a stator part channel;

a rotor part, held by a housing, and including a rotor part channel, the rotor part attachable rotatably relative to the stator part and supported rotatably, about a longitudinal axis of the nozzle relative to the stator part, by at least one roller bearing;

a centering aid formed as a centering protrusion on the stator part and a centering aid formed as a centering indentation on the rotor part, the centering protrusion configured for engaging with the centering indentation when the nozzle is mounted; and a seal forming a transition from the stator part channel to the rotor part channel, the seal including:

a rotor bearing hollow body having a conical outer contour and including a rotor bearing channel crossing the rotor bearing hollow body in a longitudinal direction, the rotor bearing hollow body arrangeable such that the rotor bearing hollow body is fixed and at least partially protrudes into the rotor part channel of the rotor part; and a stator bearing hollow body having a cylindrical shape opening into a collar and including a stator bearing channel crossing the stator bearing hollow body in a longitudinal direction, the stator bearing hollow body arrangeable such that the stator bearing hollow body is fixed and at least partially protrudes into the stator part channel of the stator part, wherein, when the nozzle is mounted, a front surface of the rotor bearing hollow body directly contacts an opposing front surface of the stator bearing hollow body forming a flat plane at the seal perpendicular to a direction of flow of the pressure-transmitting medium such that the rotor bearing hollow body and the stator bearing hollow body do not extend over one another in a direction of the longitudinal axis.

10. The nozzle according to claim 9, wherein a profile of the rotor part channel has a conical shape.

11. The nozzle according to claim 9, wherein profiles of the rotor bearing channel and the stator bearing channel are identical.

12. A nozzle, driven by a pressure-transmitting medium, for cleaning pipes, the nozzle comprising:

a stator part including a stator part channel;

a rotor part having a rotor bearing pin configured for insertion into a recess on the stator part, the rotor part held by a housing, and including a rotor part channel, the rotor part attachable rotatably relative to the stator part and supported rotatably, about a longitudinal axis of the nozzle relative to the stator part, by at least one roller bearing;

a discharge chamber for collection of the pressure-transmitting medium arranged between the stator part and the rotor part and surrounded by the housing; and a seal forming a transition from the stator part channel to the rotor part channel, the seal including:

a rotor bearing hollow body having a conical outer contour and including a rotor bearing channel crossing the rotor bearing hollow body in a longitudinal direction, the rotor bearing hollow body arrangeable such that the rotor bearing hollow body is fixed and at least partially protrudes into the rotor part channel of the rotor part; and a stator bearing hollow body having a cylindrical shape opening into a collar and including a stator bearing channel crossing the stator bearing hollow body in a longitudinal direction, the stator bearing hollow body arrangeable such that the stator bearing hollow body is fixed and at least partially protrudes into the stator part channel of the stator part;

wherein, when the nozzle is mounted, a front surface of the rotor bearing hollow body directly contacts an opposing front surface of the stator bearing hollow body forming a flat plane at the seal perpendicular to a direction of flow of the pressure-transmitting medium such that the rotor bearing hollow body and the stator bearing hollow body do not extend over one another in a direction of the longitudinal axis; and wherein, when pressure is applied to the nozzle as mounted, a stream of the pressure-transmitting medium flows through the stator part channel through the seal into the rotor part channel and an amount of the pressure-transmitting medium passes through the front surface of the stator bearing hollow body and the front surface of the rotor bearing hollow body into the discharge chamber.

13. The nozzle according to claim 12, wherein the nozzle is capable of operating at supply pressures of the pressure-transmitting medium between 1000 and 3000 bars.

14. The nozzle according to claim 12, wherein the rotor bearing hollow body and the stator bearing hollow body are formed from carbide.

15. The nozzle according to claim 12, wherein a profile of the rotor part channel has a conical shape.

16. The nozzle according to claim 12, wherein profiles of the rotor bearing channel and the stator bearing channel are identical.

17. The nozzle according to claim 12, wherein a profile of the collar of the stator bearing hollow body has flattened edges configured to prevent rotation of the stator bearing hollow body.

18. The nozzle according to claim 12, further comprising an undercut recessed in the rotary part channel for attaching the rotor bearing hollow body and an undercut recessed in the stator part channel for attaching the stator bearing hollow body.

19. The nozzle according to claim 18, wherein the rotor bearing hollow body is attached in the undercut recessed in the rotor part channel with a sealing ring and the stator bearing hollow body is attached in the undercut recessed in the stator part channel with a sealing ring.

20. The nozzle according to claim 12, further comprising a centering aid formed as a centering protrusion on the stator part and a centering aid formed as a centering indentation on the rotor part, the centering protrusion configured for engaging with the centering indentation when the nozzle is mounted.

* * * * *